US008453902B2

(12) United States Patent
Jang

(10) Patent No.: US 8,453,902 B2
(45) Date of Patent: Jun. 4, 2013

(54) NAIL GUN AND SAFETY DEVICE OF THE SAME

(75) Inventor: Jen-Fang Jang, Taichung (TW)

(73) Assignee: Basso Industry Corp., Taichung (TW)

( * ) Notice: Subject to any disclaimer, the term of this patent is extended or adjusted under 35 U.S.C. 154(b) by 375 days.

(21) Appl. No.: 12/726,353

(22) Filed: Mar. 18, 2010

(65) Prior Publication Data

US 2010/0237125 A1 Sep. 23, 2010

(30) Foreign Application Priority Data

Mar. 18, 2009 (TW) ..... 98108805 A

(51) Int. Cl.
*B25C 1/04* (2006.01)

(52) U.S. Cl.
USPC ..... 227/8; 227/142

(58) Field of Classification Search
USPC ..... 227/8, 10, 130, 142; 123/46 SC
See application file for complete search history.

(56) References Cited

U.S. PATENT DOCUMENTS

| | | | | |
|---|---|---|---|---|
| 4,403,722 | A | 9/1983 | Nikolich | |
| 4,522,162 | A | 6/1985 | Nikolich | |
| 5,197,646 | A | 3/1993 | Nikolich | |
| 5,261,587 | A * | 11/1993 | Robinson | 227/8 |
| 5,971,245 | A | 10/1999 | Robinson | |
| 6,138,887 | A * | 10/2000 | Nayrac et al. | 227/8 |
| 6,170,729 | B1 * | 1/2001 | Lin | 227/8 |
| 6,431,429 | B1 | 8/2002 | Canlas et al. | |
| 6,889,885 | B2 | 5/2005 | Ohmori | |
| 6,964,362 | B2 * | 11/2005 | Shkolnikov et al. | 227/130 |
| 6,988,648 | B2 * | 1/2006 | Taylor et al. | 227/142 |
| 7,055,729 | B2 * | 6/2006 | Taylor et al. | 227/142 |
| 7,063,053 | B2 | 6/2006 | Hirai et al. | |
| 7,097,083 | B2 * | 8/2006 | Kolodziej et al. | 227/8 |
| 7,175,063 | B2 * | 2/2007 | Osuga et al. | 227/8 |
| 7,210,431 | B2 | 5/2007 | Nishikawa et al. | |
| 8,047,414 | B2 * | 11/2011 | Kunz et al. | 227/2 |
| 8,152,038 | B2 * | 4/2012 | Rouger et al. | 227/10 |
| 8,220,686 | B2 * | 7/2012 | Kestner et al. | 227/10 |

* cited by examiner

*Primary Examiner* — Scott A. Smith
(74) *Attorney, Agent, or Firm* — Nixon & Vanderhye P.C.

(57) ABSTRACT

A nail gun includes a housing, a safety device, a gun barrel, a supporting part, a block, a nosepiece, a linkage, a contacting part, a protrusion, a front linking part, a rear linking part and an arm. The safety device is arranged on the housing. The gun barrel is located at the front end of the housing. The supporting part is arranged inside the housing and has an elastic element. The block is disposed on the gun barrel. The nosepiece and the linkage are slidably arranged on the gun barrel. The contacting part is located at the front end of the nosepiece. The protrusion is applied to against the block. The front linking part is located at the rear end of the nosepiece. The rear linking part detachably connects the front linking part. The arm is located at the rear end of the linkage and against the elastic element.

14 Claims, 10 Drawing Sheets

NAIL GUN AND SAFETY DEVICE OF THE SAME

RELATED APPLICATIONS

This application claims priority to Taiwan Patent Application Number 98108805, filed Mar. 18, 2009, which is herein incorporated by reference.

BACKGROUND

1. Technical Field

The present disclosure relates to nail guns.

2. Description of Related Art

A nail gun is applied to launch nails to fix a first workpiece on a second workpiece. A safety device is arranged on the front end of the nail gun to ensure the nail can be launched only after the safety device is bypassed by contacting and pressing the first workpiece.

However, the nail may sometimes be jammed in the track of the gun barrel. To complete the troubleshooting, the nosepiece of the safety device must be dismantled troublesomely.

SUMMARY

In one embodiment of the disclosure, a nail gun is disclosed. The nail gun includes a housing and a safety device. The safety device is arranged on the housing. The housing includes a gun barrel, a supporting part and a block. The gun barrel is located at the front end of the housing. The supporting part is arranged inside the housing and has an elastic element. The block is disposed on the gun barrel. The safety device includes a nosepiece and a linkage. The nosepiece and the linkage are slidably arranged on the gun barrel. The nosepiece includes a contacting part, a protrusion and a front linking part. The contacting part is located at the front end of the nosepiece. The protrusion is applied to against the block. The front linking part is located at the rear end of the nosepiece. The linkage includes a rear linking part and an arm. The rear linking part detachably connects the front linking part. The arm is located at the rear end of the linkage and arranged inside the housing to against the elastic element.

In another embodiment of the disclosure, a safety device for a nail gun is disclosed. The safety device includes a nosepiece and a linkage. The nosepiece and the linkage are slidably arranged on a gun barrel of the nail gun. The nosepiece includes a contacting part and a front linking part. The contacting part is located at the front end of the nosepiece. The front linking part is located at the rear end of the nosepiece. The linkage includes a rear linking part and an arm. The rear linking part detachably connects the front linking part. The arm is located at the rear end of the linkage and arranged inside a housing of the nail gun.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
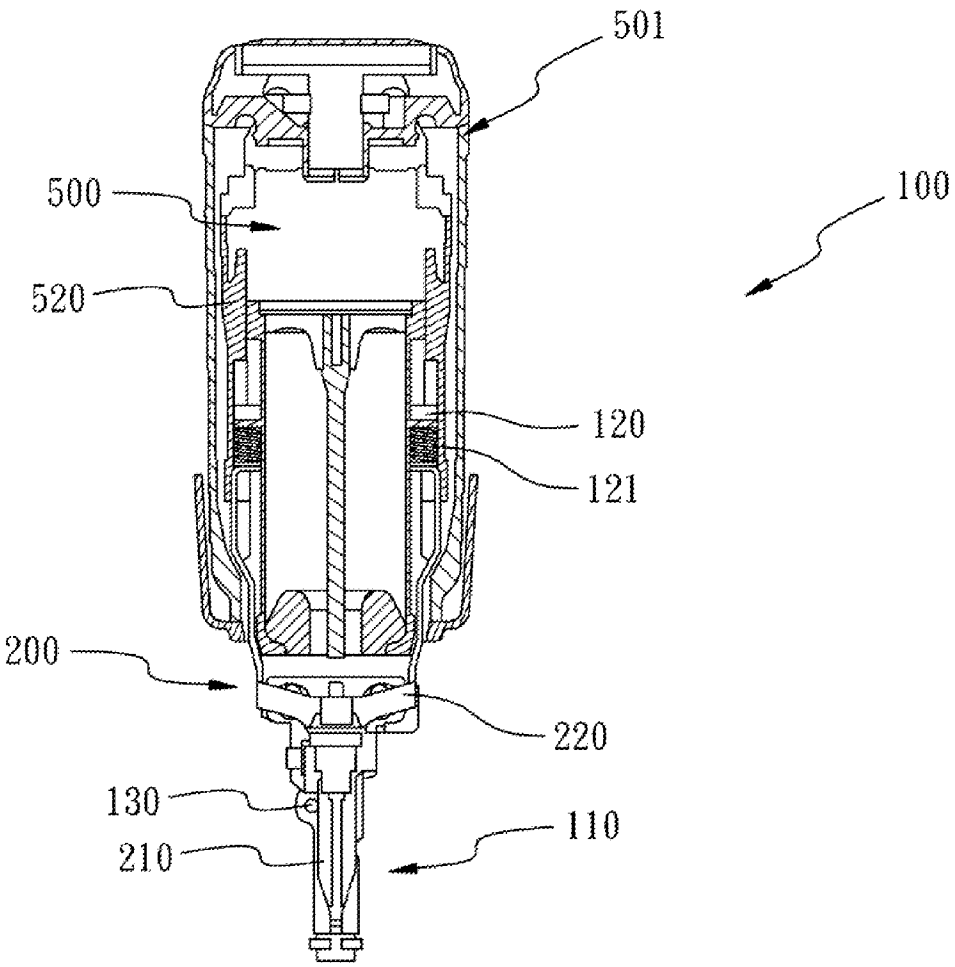
FIG. 1 is a schematic view of a nail gun of one embodiment of the disclosure.
Figure 2:
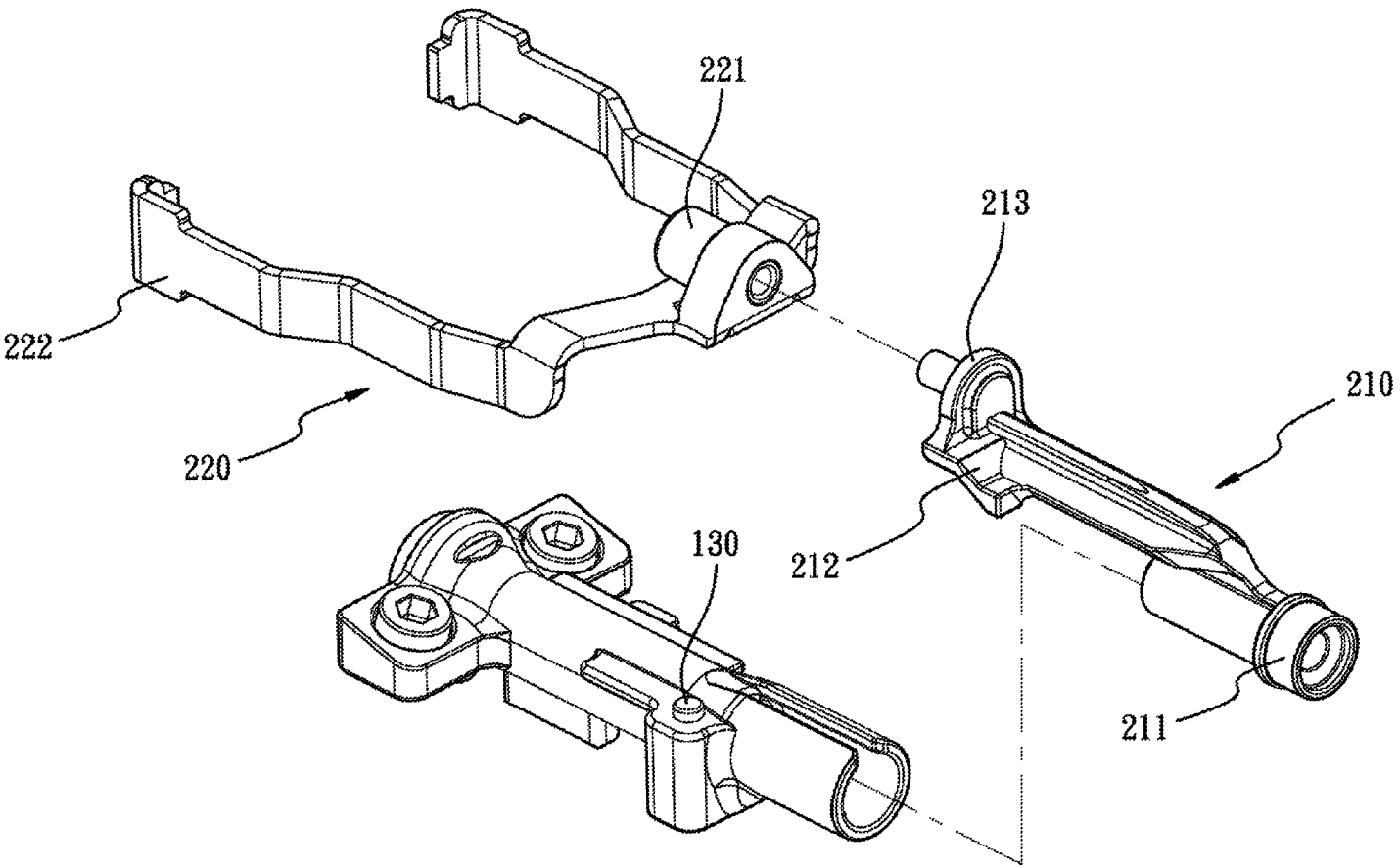
FIG. 2 is a schematic view of the safety device 200 of FIG. 1.

FIG. 1 is a schematic view of a nail gun of one embodiment of the disclosure. FIG. 2 is a schematic view of the safety device 200 of FIG. 1. The front end of the nail gun means the direction of a nail being launched. The rear end of the nail gun means the opposite direction of the front end. As being depicted in FIG. 1 and FIG. 2, the nail gun includes a housing 100 and a safety device 200. The housing 100 includes a gun barrel 110, a supporting part 120 and a block 130. The gun barrel 110 is located at the front end of the housing 100, and the block 130 is located at the upper surface of the gun barrel 110. The supporting part 120 is arranged inside the housing of the housing 100, and an elastic element 121 is installed at the front end of the supporting part 120. In detail, the supporting part 120 is protruded from the housing of the housing 100 or from the cylinder of the combustion chamber 500 when the embodiment is applied to a combustion nail gum.

The safety device 200 includes a nosepiece 210 and a linkage 220 can be grouped as a safety device 200. The nosepiece 210 is arranged on the gun barrel 110 and detachably connects the linkage 220. Part of the linkage 220 is inserted into the housing 100 of the nail gun, and connected to the elastic element 121. Therefore, the elastic element 121, such as a spring, is compressed when the nosepiece 210 is pressed by a workpiece via the contacting part.

The elastic force of the elastic element 121 is applied to regress the nosepiece 210 when the workpiece is removed. In detail, the linkage 220 includes a pair of arms 222 pressed by the elastic element 121 and also against to the sleeve 520, such as being fixed on the sleeve 520. The linkage 220 also includes the recess seat 221. Furthermore, the block 130 of the gun barrel 110 detents the protrusion 212 of the nosepiece 210, and thus prevents the nosepiece 210 from falling off.

In another aspect of the embodiment, a combustion nail gum is disclosed. The combustion nail gum includes a gun barrel 110, a combustion chamber 500, at least one safety exhaust passage 501, a sleeve 520, a nosepiece 210, a linkage 220, a recess seat 221, a pin 213, a protrusion 212 and a block 130. The combustion chamber 500 is connected to the gun barrel 110, and the safety exhaust passage 501 is connected to the combustion chamber 500. The sleeve 520 is movably connected to the combustion chamber 500 to selectively open and close the safety exhaust passage 501. The nosepiece 210 is slidably disposed alongside the gun barrel 110, and the linkage 220 connects the nosepiece 210 and the sleeve 520. The recess seat 221 is connected to the linkage 220 and has a recess therein. The pin 213 is connected to the nosepiece 210 and inserted into the recess of the recess seat 221. The protrusion 212 protrudes from the nosepiece 210, and the block 130 is disposed on the gun barrel 110 to restrain the protrusion 212 from being moved over the block 130. Therefore, the nosepiece 210 can be attached or detached via the recess seat 221, the pin 213, the protrusion 212 and the block 130.

The safety exhaust passage 501 is closed by the sleeve 520 when the nosepiece 210 is pressed by the workpiece. Therefore, the cylinder of the combustion chamber 500 is ignited to push the nail. Meanwhile, the elastic element 121 is compressed between the linkage 220 and the supporting part 120.

In still another aspect of the embodiment, the pin 213 of the nosepiece 210 can be regarded as a front linking part, and the recess seat 221 of the linkage 220 can be regarded as a rear linking part. The nosepiece 210 is detachable over the linkage 220 via the front linking part and the rear linking part, i.e. the pin 213 and the recess seat 221. The pin 213 and the nosepiece 210 can be made out of one piece, and the recess seat 221 and the linkage 220 can be made out of one piece.

In another embodiment of the disclosure, the locations of the front linking part and the rear linking part can be exchanged. In other words, a pin seat is applied to replace the recess seat 221, and a recess is applied to replace the pin 213 respectively. In detail, the pin seat is connected to the linkage 220 and has a pin therein. The recess is connected to the nosepiece 210 and inserted by the pin of the pin seat.

Figure 3:
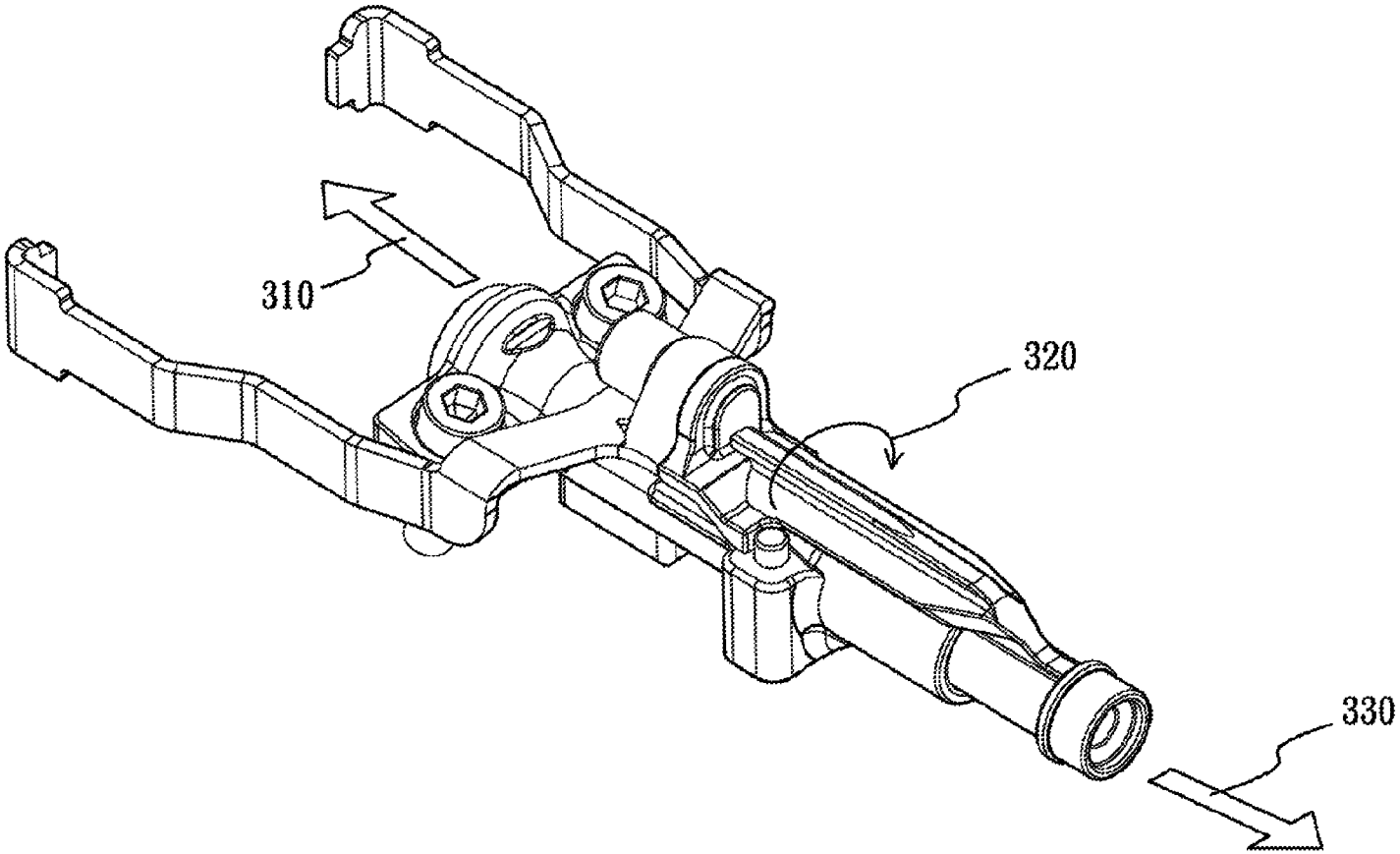
FIG. 3 is a schematic view of FIG. 2 depicting one set of detaching steps.
Figure 4:
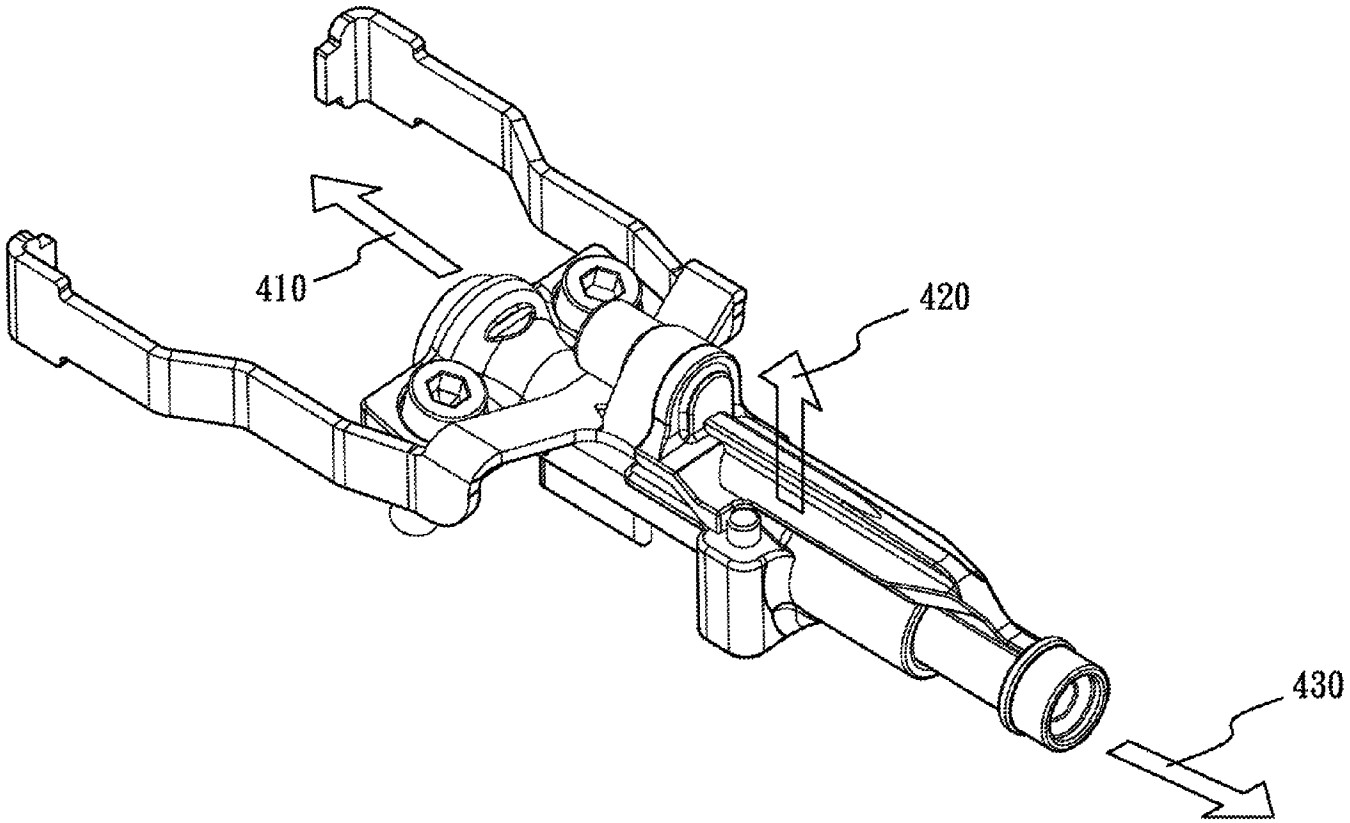
FIG. 4 is also a schematic view of FIG. 2 depicting another set of detaching steps.

FIG. 3 is a schematic view of FIG. 2 depicting one set of detaching steps. FIG. 4 is also a schematic view of FIG. 2 depicting another set of detaching steps. The elastic force of the elastic element 121 and the block 130 firmly detent the nosepiece 210 on the gun barrel 110. The detaching steps of the nosepiece 210 are shown as following:

First, as shown in step 310 (410), the safety device 200 is pressed to the rear end of the nail gun. The elastic element 121 is compressed, and a space is made out between the protrusion 212 and the block 130. Second, as shown in step 320 or step 420, the nosepiece 210 is rotated or lifted, and the protrusion 212 is departed from the block 130. Third, as shown in step 330 (430), the nosepiece 210 is pulled out from the front end of the gun barrel 110. Therefore, the nosepiece 210 of the nail gun can be detached easily for troubleshooting when the nail is jammed in the track of the gun barrel 110.

Figure 5:
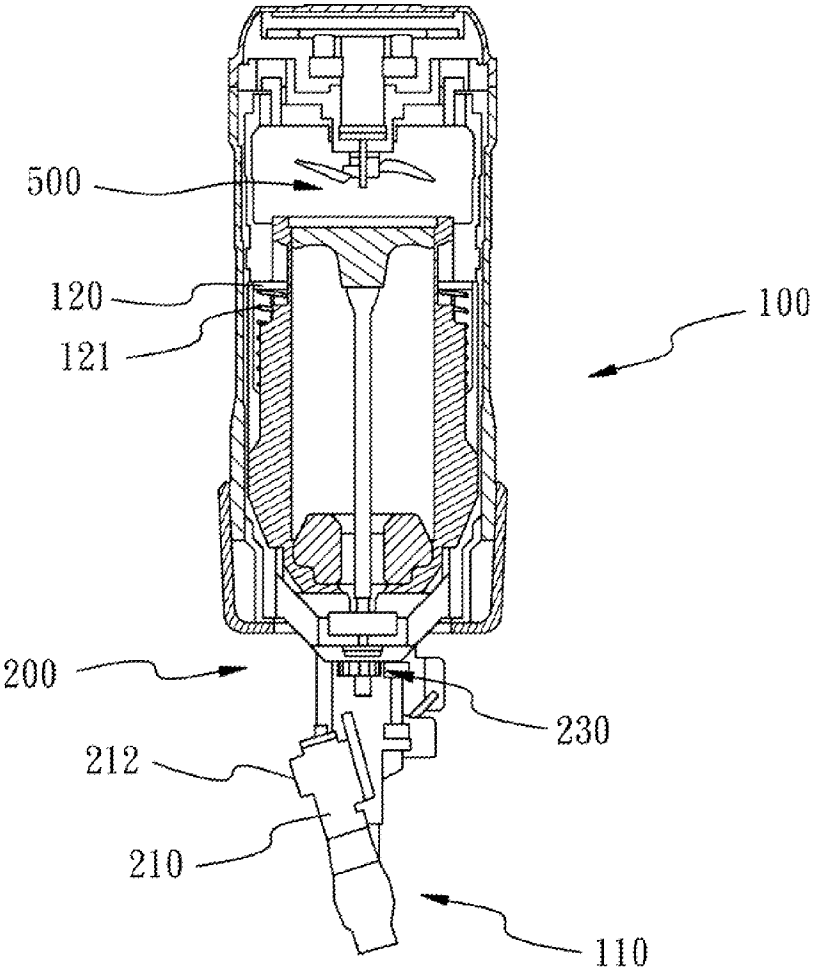
FIG. 5 is a schematic view of a nail gun of another embodiment of the disclosure.
Figure 6:
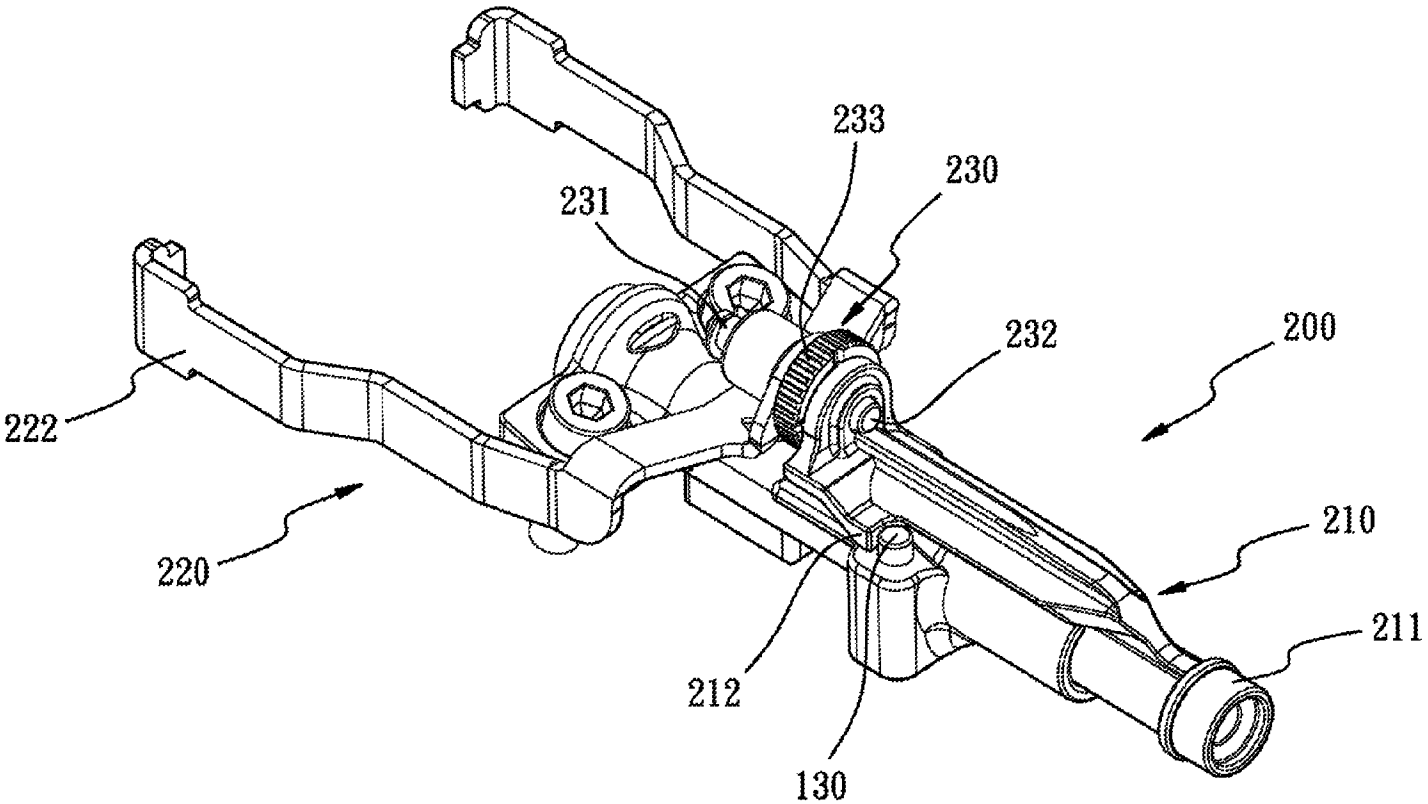
FIG. 6 is a schematic view of the safety device 200 of FIG. 5.

FIG. 5 is a schematic view of a nail gun of another embodiment of the disclosure. FIG. 6 is a schematic view of the safety device 200 of FIG. 5. The rear linking part can be designed to have an adjustable threaded fastener. Take the recess seat 221 for instance, the recess seat 221 has an adjustable threaded fastener that connects the recess seat 221 to the linkage 220.

In other words, the recess seat 221 includes a length adjusting element 230. The length adjusting element 230 is arranged to connect the nosepiece 210 and the linkage 220. The length adjusting element 230 is applied to adjust the total length of the safety device 200, and the nosepiece 210 can be detached from the length adjusting element 230.

In one embodiment, the length adjusting element 230 includes a screwing part 231, a knob 233 and a pin 232 to detachably connect the recess of the nosepiece 210. In another embodiment, the length adjusting element 230 includes a screwing part 231, a knob 233 and a recess to detachably connect the pin of the nosepiece 210.

Figure 7B:
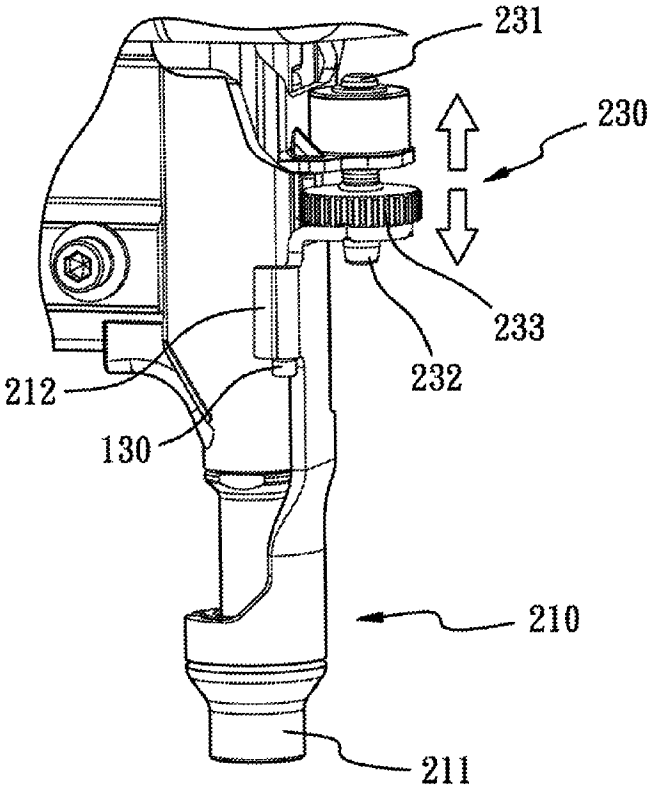
FIG. 7B is also a schematic view of the length adjusting element 230 of FIG. 6 depicting a longer length of the safety device 200.
Figure 7A:
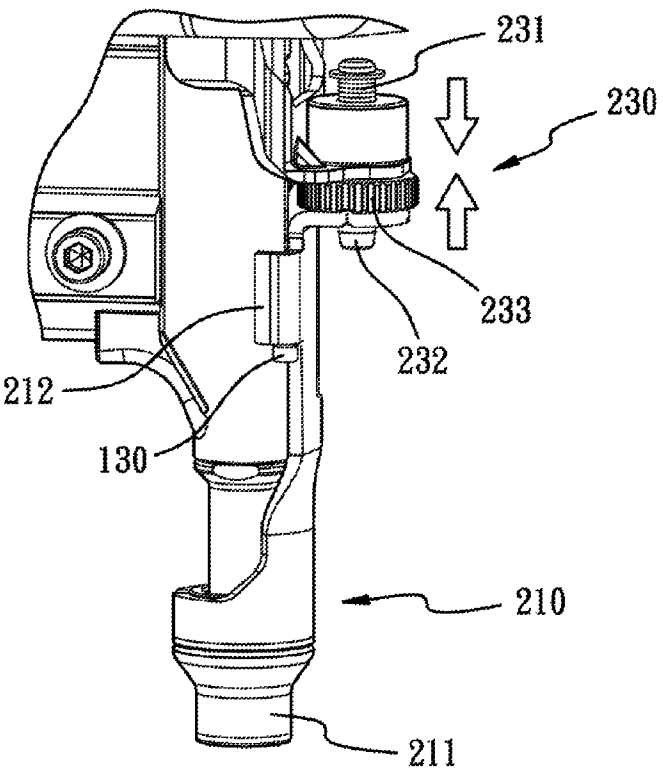
FIG. 7A is a schematic view of the length adjusting element 230 of FIG. 6 depicting a shorter length of the safety device 200.

FIG. 7A is a schematic view of the length adjusting element 230 of FIG. 6 depicting a shorter length of the safety device 200. FIG. 7B is also a schematic view of the length adjusting element 230 of FIG. 6 depicting a longer length of the safety device 200. The linkage 220 has a threaded hole to fasten the screwing part 231 in a particular distance. Therefore, the length adjusting element 230 can be applied to adjust the total length of the safety device 200.

Figure 8C:
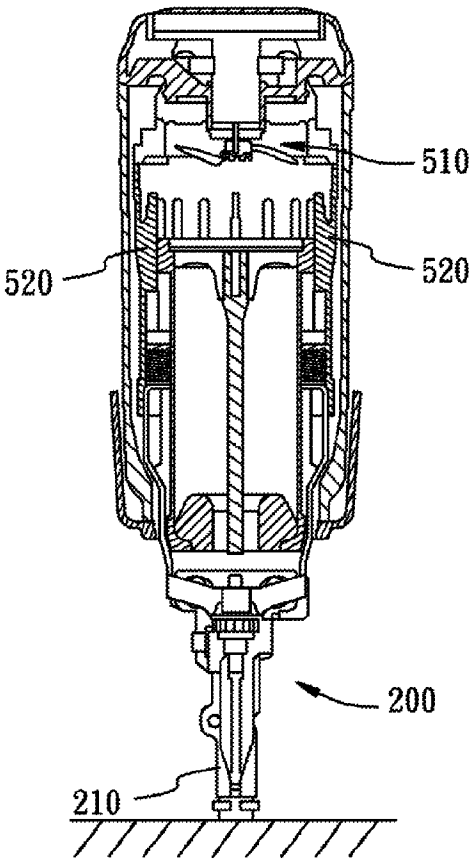
FIG. 8C is still another operating state view of FIG. 1 depicting the nosepiece 210 is pressed by a workpiece.
Figure 8B:
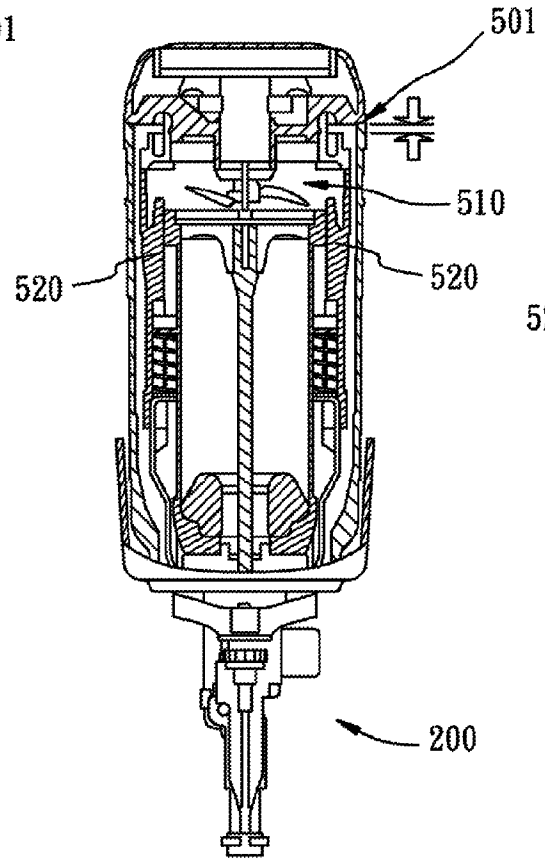
FIG. 8B is another operating state view of FIG. 1 depicting a longer length of the safety device 200.
Figure 8A:
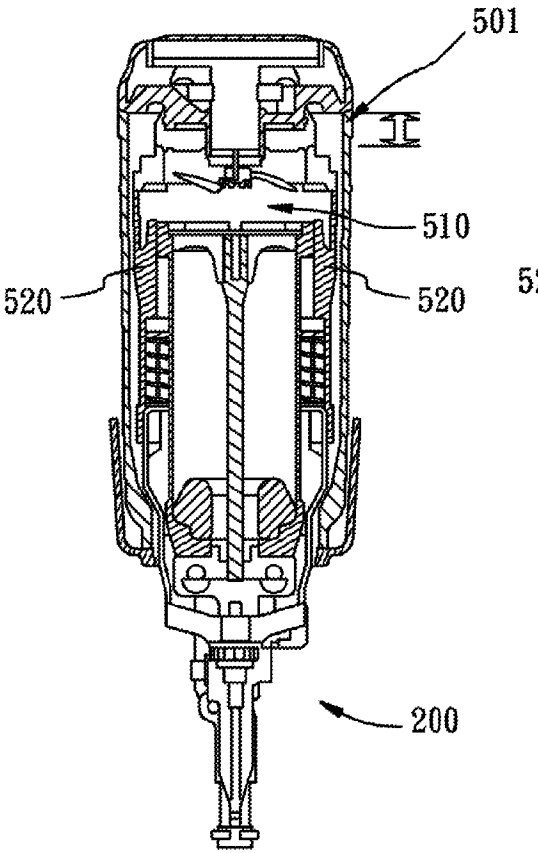
FIG. 8A is one operating state view of FIG. 1 depicting a shorter length of the safety device 200.

FIG. 8A is one operating state view of FIG. 1 depicting a shorter length of the safety device 200. FIG. 8B is another operating state view of FIG. 1 depicting a longer length of the safety device 200. FIG. 8C is still another operating state view of FIG. 1 depicting the nosepiece 210 is pressed by a workpiece. The size of the safety exhaust passage 501 is controlled by the location of the sleeve 520, and the location of the sleeve is controlled by the length of the safety device 200. Therefore, the length adjusting element 230 can be applied to control the size of the safety exhaust passage 501. The combustion power of the cylinder 510 is controlled by the concentration of the gas and the oxygen of the air. Therefore, when the combustion nail gun is applied to launch many nails, the size of the safety exhaust passage 501 controls the concentration of the oxygen of the air. In other words, the length adjusting element 230 is applied to tune the combustion power of the combustion nail gun.

Figure 9:
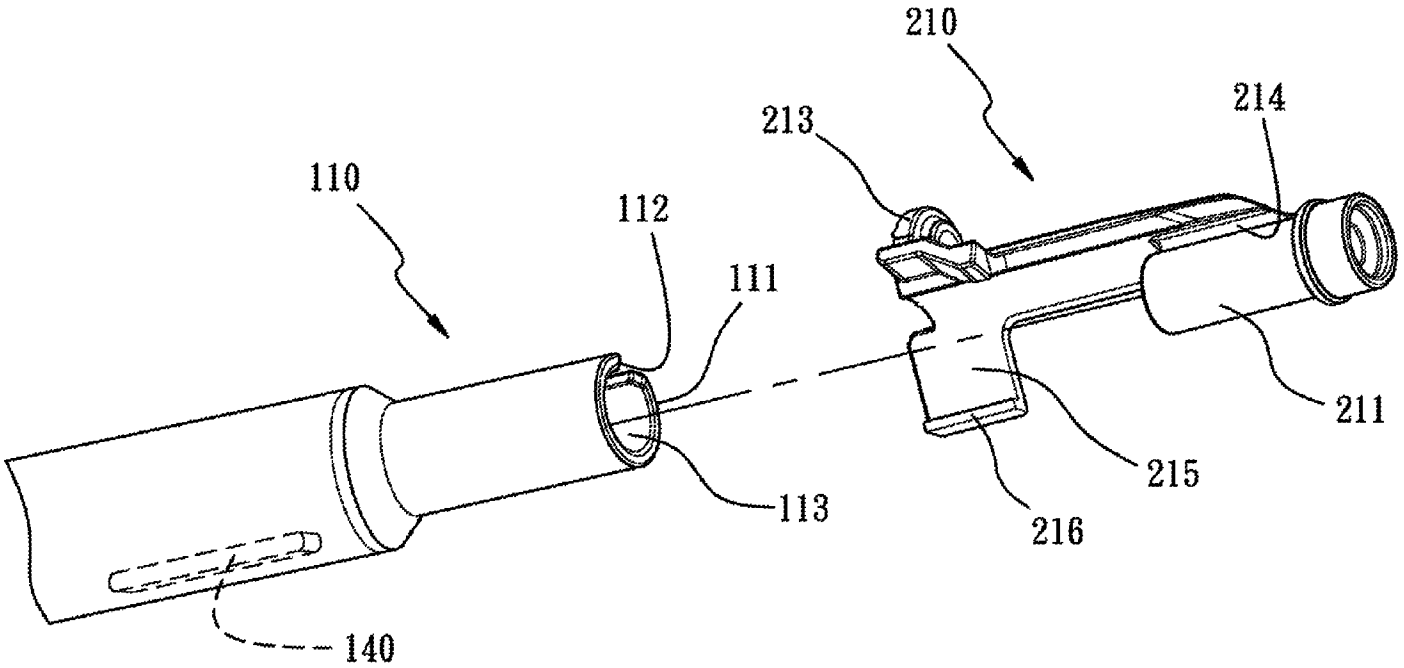
FIG. 9 is a partial schematic view of a nail gun of third embodiment of the disclosure.

FIG. 9 is a partial schematic view of a nail gun of third embodiment of the disclosure. In FIG. 9, the nosepiece 210 further includes a holding piece 215, a sliding block 216, a neck 214 and a connecting tube 211. The gun barrel 110 further includes a U-shaped breach 112 and a chute 140. The holding piece 215 is located at the lateral side of the nosepiece 210 for holding the gun barrel 110. The sliding block 216 is located at one end of the holding piece 215, and the sliding block 216 is slidably coupled into the chute 140 of the gun barrel 110. The neck 214 connects to the nosepiece and slidably couples to the U-shaped breach 112. The connecting tube 211 is connected to the nosepiece 210 and inserted into the track 113 of the gun barrel 110. Therefore, these features improve the stability when the nosepiece 210 is attached on the gun barrel 110.

Figure 10:
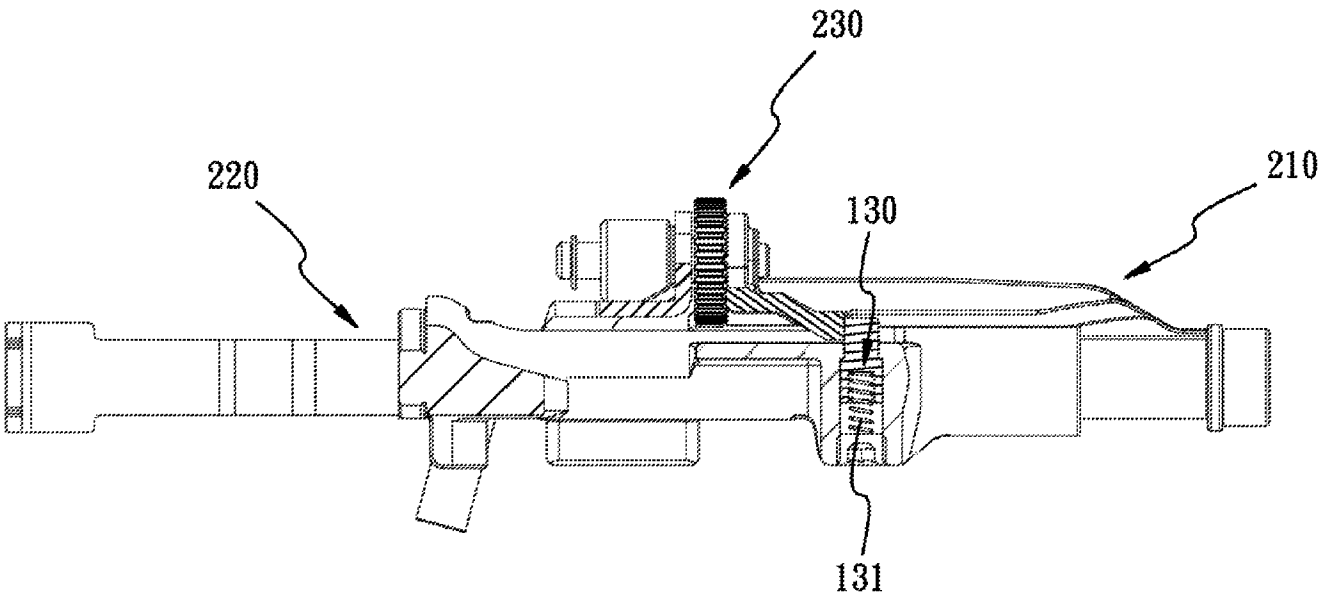
FIG. 10 is a lateral view of FIG. 6.

FIG. 10 is a lateral view of FIG. 6. In FIG. 10, the block 130 includes a spring 131 and a button, and the spring 131 connects the button to the gun barrel 110. Therefore, the block 130 can be pressed down to release the protrusion 212 of the nosepiece 210. In another aspect of the embodiment, the block 130 can be made of a flexible material. Therefore, the block 130 can be bend to release the protrusion 212.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A nail gun comprising:

a gun barrel located at a front end of a housing and extending in an axial direction;

a supporting part arranged inside the housing;

an elastic element disposed forwardly of and in abutment with the supporting part in the housing;

a block disposed on the gun barrel;

a nosepiece slidably and detachably arranged on the gun barrel in the axial direction and terminating at opposite front and rear ends in the axial direction, including a contacting part which is located at the front end of the nosepiece, a protrusion which is disposed offset from an axis of the gun barrel and adjacent to the rear end of the nosepiece, which is disposed behind the block relative to the front end, and which is slidable relative to the block in the axial direction between operating and non-operating positions, where the protrusion is disengaged from and engaged with the block, respectively, and a rearward linking part which is located at the rear end of the nosepiece; and a linkage arranged on the gun barrel and disposed to be movable with the nosepiece in the axial direction, including a forward linking part configured to permit the rearward linking part to be detachably engaged therein and rotatable thereto about the axis and liftable therefrom, and an arm disposed to extend from an end of the forward linking part rearward to terminate at an abutment end which is disposed forwardly of and biased by the elastic element to move the protrusion toward the non-operating position, such that as a result of the nosepiece being manually pushed against the biasing force of the elastic element, the protrusion is disengaged from the block so as to permit the protrusion to be turned about the axis thereby enabling the detachment of the rearward linking part from the forward linking part.

2. The nail gun of claim 1, wherein the rearward linking part is a pin, and the forward linking part is a recess seat having a recess therein.

3. The nail gun of claim 2, wherein the recess seat has an adjustable threaded fastener connecting the recess seat to the linkage.

4. The nail gun of claim 1, wherein the rearward linking part is a recess seat having a recess therein, and the forward linking part is a pin.

5. The nail gun of claim 4, wherein the recess seat has an adjustable threaded fastener connecting the recess seat to the linkage.

6. The nail gun of claim 1, further comprising:

a combustion chamber inside the housing and connected to the gun barrel via a cylinder of the nail gun;

at least one safety exhaust passage connected to the combustion chamber; and a sleeve movably connected to the combustion chamber for selectively opening and closing the safety exhaust passage.

7. The nail gun of claim 6, wherein the linkage is connected to the sleeve.

8. The nail gun of claim 1, wherein the block comprises:

a spring-loaded button slidably protruding from the gun barrel.

9. The nail gun of claim 1, wherein the block is made of a flexible material.

10. The nail gun of claim 1, further comprising a holding piece located at the lateral side of the nosepiece for holding the gun barrel.

11. The nail gun of claim 10, further comprising a sliding block located at one end of the holding piece, wherein the gun barrel has a chute therein, and the sliding block is slidably coupled to the chute of the gun barrel.

12. The nail gun of claim 1, further comprising:

a U-shaped breach in the gun barrel; and a neck connected to the nosepiece and slidably coupled to the U-shaped breach.

13. The nail gun of claim 1, further comprising:

a connecting tube connected to the nosepiece and inserted into the track of the gun barrel.

14. A nail gun comprising:

a gun barrel located at a front end of a housing;

a supporting part arranged inside the housing;

an elastic element disposed forwardly of and in abutment with the supporting part in the housing;

a block disposed on the gun barrel;

a nosepiece slidably and detachably arranged on the gun barrel in the axial direction and terminating at opposite front and rear ends in the axial direction, including a contacting part which is located at the front end of the nosepiece; and a protrusion which is disposed offset from an axis of the gun barrel and adjacent to the rear end of the nosepiece, which is disposed behind the block relative to the front end, and which is slidable relative to the block in the axial direction between operating and non-operating positions, where the protrusion is disengaged from and engaged with the block, respectively, against the block;

a linkage arranged on the gun barrel, disposed to be movable with the nosepiece in the axial direction, and configured to permit the nosepiece to be detachably engaged therein and rotatable thereto about the axis, the linkage including:

an arm disposed to extend from an end of the linkage to terminate at an abutment end which is disposed forwardly of and biased by the elastic element to move the protrusion toward the non-operating position, such that as a result of the nosepiece being manually pushed against the biasing force of the elastic element, the protrusion is disengaged from the block so as to permit the protrusion to be turned about the axis thereby enabling the detachment of the nosepiece from the linkage.

* * * * *